US005658432A

United States Patent [19]

Heaven et al.

[11] Patent Number: 5,658,432

[45] Date of Patent: Aug. 19, 1997

[54] APPARATUS AND METHOD OF DETERMINING SHEET SHRINKAGE OR EXPANSION CHARACTERISTICS

[75] Inventors: Edwin Michael Gyde Heaven, North Vancouver, Canada; Scott B. Crumpacker, Vancouver, Wash.

[73] Assignee: Measurex Devron Inc., North Vancouver, Canada

[21] Appl. No.: 518,970

[22] Filed: Aug. 24, 1995

[51] Int. Cl.[6] ..... D21F 7/06; D21F 1/06

[52] U.S. Cl. ..... 162/198; 162/253; 162/263; 162/266; 162/DIG. 10; 73/159; 364/471.01; 364/471.02; 364/471.03

[58] Field of Search ..... 162/198, 252, 162/253, 134, 266, 263, DIG. 10, DIG. 11; 73/159; 364/471, 471.01, 471.02, 471.03

[56] References Cited

U.S. PATENT DOCUMENTS

| | | | |
|---|---|---|---|
| 1,407,247 | 2/1922 | Brewster | 162/266 |
| 2,326,088 | 8/1943 | Witham | 73/159 |
| 2,730,898 | 1/1956 | Fry, Jr. | 73/159 |
| 3,437,823 | 4/1969 | Jocye | 162/263 X |
| 3,497,802 | 2/1970 | Biddle | 162/263 |
| 3,726,125 | 4/1973 | Heyman | 73/15 R |
| 4,680,089 | 7/1987 | Aral et al. | 162/198 |
| 4,707,779 | 11/1987 | Hu | 364/148 |
| 4,903,528 | 2/1990 | Balakrishnan et al. | 73/159 |
| 4,947,684 | 8/1990 | Balakrishnan | 73/159 |
| 4,982,334 | 1/1991 | Balakrishnan | 364/479 |
| 5,093,795 | 3/1992 | Lewis | 364/471 |
| 5,121,332 | 6/1992 | Balakrishnan et al. | 364/471 |
| 5,262,955 | 11/1993 | Lewis | 364/471 |
| 5,298,121 | 3/1994 | Kilmister | 162/198 |

OTHER PUBLICATIONS

W. L. Bialkowski and Alan D. Weldon; The Digital future of process control; possibilities, limitations, and ramifications; Oct. 1994; pp. 69–75; vol. 77, No. 10 Tappi Journal; Technical Association of the pulp and paper industry.

*Primary Examiner*—Donald E. Czaja
*Assistant Examiner*—Jon A. Fortuna
*Attorney, Agent, or Firm*—Christie, Parker & Hale, LLP

[57] ABSTRACT

A method for determining the cross-machine shrinkage or expansion profile of a travelling sheet produced in a sheet-making machine between an upstream location and a downstream location. The method involves marking the sheet at the upstream location with an array of marks at measured, predetermined intervals in the cross-machine direction. The sheet is inspected in the cross-machine direction at the downstream location to measure the spacing of the array of marks. A shrinkage or expansion profile of the travelling sheet is developed based on the changes in the spacing between the array of marks at the downstream location. Apparatus for carrying out the method is also disclosed. The method and apparatus of the present invention permit rapid and precise determination of the sheet shrinkage or expansion profile to allow for better control of property variation across the sheet.

16 Claims, 1 Drawing Sheet

APPARATUS AND METHOD OF DETERMINING SHEET SHRINKAGE OR EXPANSION CHARACTERISTICS

FIELD OF THE INVENTION

This invention relates to sheetmaking systems, and, more particularly, to a method and apparatus for determining the shrinkage profile of a sheet of material under manufacture.

BACKGROUND OF THE INVENTION

Conventional papermaking machinery for producing a continuous sheet of paper includes equipment to set the sheet properties of the paper as it is being manufactured. Generally, on-line measurements of sheet properties, such as thickness, gloss or smoothness are made by scanning sensors that travels back and forth across the width of the sheet of paper in the cross-machine direction (CD). The scanning sensors are located downstream of actuators that are controlled to adjust the sheet properties. The scanning sensors collect information about the sheet properties to develop a property profile across the sheet and provide control signals to the appropriate actuators to adjust the profile toward a desired target profile in a feedback loop. In practice, the actuators provide generally independent adjustment at adjacent cross-directional locations of the sheet, normally referred to as slices.

In conventional papermaking machinery, the sheet of material being manufactured tends to shrink in the cross-machine direction as it travels through the papermaking machinery. This is particularly true at the stage where the sheet passes through drying equipment. This shrinkage is not uniform across the sheet and, therefore, it is important to be able to establish a shrinkage profile across the sheet. Due to non-uniform shrinkage of the sheet, a downstream sheet slice that is measured a distance in from the edge of the sheet may be adjusted by activating an upstream actuator that is a significantly different distance in from the edge of the sheet. It is important to be able to establish the relationship between each downstream slice where scanning measurements occur and the corresponding upstream actuator that must be adjusted to control the particular downstream slice.

Identifying the shrinkage profile across a sheet as it passes from the formation process through dryers is a requirement for precise control of the sheet properties across the sheet. Traditional techniques for establishing a shrinkage profile have relied on manual tests where the sheet is marked with dye at an upstream location and the location of the dye is then manually measured at a downstream location after the drying process. The test is repeated at various locations across the width of the sheet. Based on the spacing of the measured downstream dye marks when compared with the known upstream dye positions, a shrinkage profile can be determined. This test requires considerable manual effort to visually identify the centre of each dye mark and relate it to a physical location on the sheet which is travelling by the observer at great speed. The accuracy of the shrinkage profile is compromised by manual or calculated measurement precision. Dye must be applied for a sufficient period to allow the observer to locate and measure all mark centres which often means making dyed sheet paper for several minutes. The dyed sheet paper produced is not saleable.

Alternatively, bump tests can be used to determine the shrinkage profile which involves adjusting specific upstream actuators across the sheet and measuring the location in the downstream sheet after the drying process where a response is detected. The responses must be identified from within inherent process variability which is often quite significant near the sheet edges (due to wave or localized edge process variation) where much of the shrinkage occurs. The bump response centres are often difficult or impossible to identify close to the sheet edge particularly on heavyweight profiles due to localized variability. Furthermore, bump tests often take 30 minutes to an hour to complete due to averaging necessary to determine the true response. During this period the sheet material produced is effectively wasted since it is not saleable.

SUMMARY OF THE INVENTION

The foregoing techniques for determining the shrinkage profile suffer from the disadvantage that results are not particularly accurate and the tests often take a relatively long time to conduct during which time the sheet material produced is wasted.

Applicant has developed a new method and apparatus for determining the paper shrinkage characteristics of a sheet that avoids or minimizes the disadvantages of prior techniques by exploiting a precisely engineered dye bar to automatically mark the sheet with dye marks and optical sheet inspection technology after the drying process to detect and precisely measure the location of the dye marks to determine the sheet shrinkage profile.

In a first aspect the present invention provides a method for determining the cross-machine shrinkage profile of a travelling sheet produced in a sheetmaking machine between an upstream location and a downstream location comprising the steps of:

marking the sheet at the upstream location with an array of marks at measured, pre-determined intervals in the cross-machine direction;

inspecting the sheet in the cross-machine direction at the downstream location to measure the spacing of the array of marks; and developing a shrinkage profile of the travelling sheet based on the changes in the spacing between the array of marks at the downstream location.

In a further aspect the present invention provides apparatus for determining the cross-machine shrinkage profile of a travelling sheet produced in a sheetmaking machine between an upstream location and a downstream location comprising:

means for marking the sheet at the upstream location with an array of marks at measured, predetermined intervals in the cross-machine direction; and means for inspecting the sheet in the cross-machine direction at the downstream location to measure the spacing of the array of marks whereby the changes in the spacing between the array of marks at the downstream location as compared to the upstream location are used to develop a shrinkage profile of the travelling sheet.

The method and apparatus of the present invention permit rapid and precise location of the dye marks across the sheet in a matter of seconds thereby reducing wasted product. Process disturbances are minimized, manual errors in centre identification of dye marks is eliminated and labour is reduced.

BRIEF DESCRIPTION OF THE DRAWING

Aspects of the present invention are illustrated, merely by way of example, in the accompanying drawings in which.

DESCRIPTION OF THE PREFERRED EMBODIMENT

Figure 1:
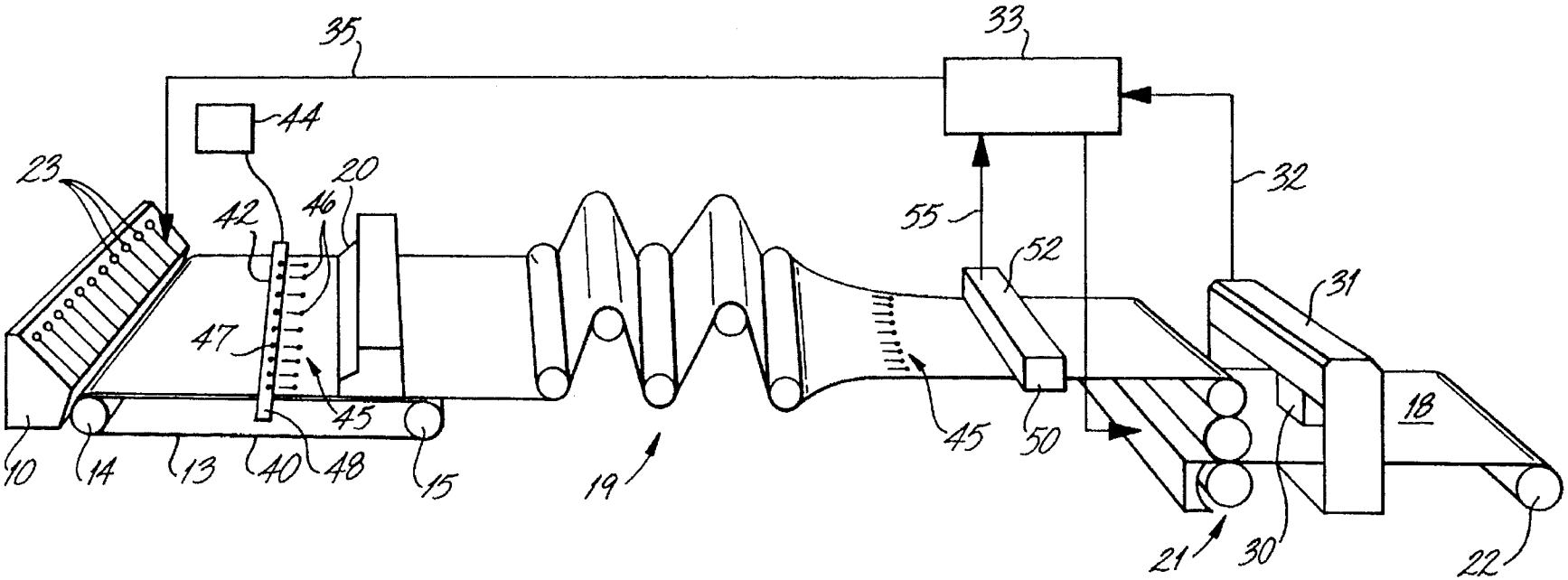
FIG. 1 is a schematic view of sheet-making machinery incorporating the apparatus of the present invention.

Referring to FIG. 1, there is shown a sheetmaking machine for producing continuous sheet material. The sheet making machine includes a feed box 10 which discharges raw material, such as paper pulp, onto a supporting web 13 trained between rollers 14 and 15. Further, the sheetmaking machine includes processing stages, such as a steam box 20, a dryer 19 and a calendering device 21 which operate upon the raw material as it travels through the machinery to produce a finished sheet 18 which is collected on reel 22.

In conventional sheetmaking practice, the processing stages along the machine of FIG. 1 each include actuators for controlling parameters of sheet 18. In the illustrated embodiment, for instance, feed box 10 includes independently adjustable actuators 23 which control the quantity of material fed onto web 13 at adjacent cross-directional locations referred to as "slices". Similarly, calendering stage 21 can include actuators for controlling the compressive pressure applied to sheet 18 at various slice locations.

To provide control information for operating the profile actuators on the sheetmaking machinery of FIG. 1, at least one scanning sensor 30 is mounted on the sheetmaking machine to measure a selected sheet property during production of the sheet material. Scanning sensor 30 is connected, as by line 32, to a controller 33 that analyses the signals from the scanning sensor and sends control signals to actuators at the processing stages of the sheetmaking machine. For example, line 35 carries control signals from controller 33 to actuators 23 at feedbox 10.

In FIG. 1, it is readily apparent that sheet material 18 shrinks in the cross-machine direction after passing through dryer 19. The apparatus and method of the present invention are used to determine the shrinkage profile of the sheet. At position 40 upstream of dryer 19, means for marking the sheet with an array of spaced marks are provided in the form of a dye distribution bar 42 extending across the sheet.

In a preferred embodiment, the dye bar comprises an elongate member 48 that extends across the sheet material in the cross-machine direction. A number of spray nozzles 47 are movably attached to the elongate member for positioning at desired spacing intervals. Each spray nozzle of the dye bar is connected to a reservoir 44 containing a marking dye or other suitable agent for marking the sheet material by spray application through the nozzles 47. The spray nozzles create an array 45 of individual marks 46 across sheet 18. Because sheet 18 is generally travelling at high speed and the spray nozzles are activated for a set time, the marks tend to be elongate streaks extending in the machine direction.

By using positionable spray nozzles, the spacing of the individual marks 46 in the array can be adjusted. In particular, the spray nozzles can be positioned so that more marks are formed at the outer edges of the sheet material where there is a tendency for greater shrinkage. The greater number of marks adjacent the edges permits more accurate determination of the shrinkage profile in this region.

In an alternative arrangement, dye distribution bar 42 comprises an elongate dye receptacle that is formed with spaced apertures that release dye onto the sheet at predetermined locations to create an array of individual marks across sheet 18.

At location 50 downstream of dryer 19, means for inspecting the sheet in the cross-machine direction are provided in the form of optical sensing means 52 for detecting and measuring the position of the dye marks. Preferably, optical sensing means 52 comprises the existing optical inspection system of the papermaking machinery. The optical inspection system is designed to rapidly identify and precisely locate sheet defects across the sheet. This inspection system can be adjusted to detect and measure the location of the dye marks at downstream location 50 when it is desired to determine a shrinkage profile. The inspection system then provides precise measurements as to the location of the centre of the dye marks. This information is transmitted to controller 33 via signal line 55 where it is compared to the spacing of the dye marks at the upstream location. Changes in the spacing between the array of marks at the downstream location 50 as compared to the upstream location 40 are used to develop a shrinkage profile of the travelling sheet 18. The controller 33 uses the shrinkage profile to account for variable shrinkage across the sheet when providing control signals to upstream actuators in response to downstream sheet property measurements. Once shrinkage profile measurements are made, the optical system can be reset to its normal function of locating sheet defects.

Traditional dye tests in papermaking usually use visible blue or green dye. The same dyes can be applied using the dye distribution bar 42 of the present invention. However, since optical scanning means 52 can be adjusted to detect sheet variation at different wavelengths than a human inspector, it is possible to use various invisible dyes with a chemical composition that can be detected by the optical scanning means. It is also anticipated that cool water can be used as a marking agent in which case the optical scanning means 52 would be adjusted to detect infrared variations in the sheet material to develop a shrinkage profile.

The above discussion has focussed on the determination of the shrinkage profile of a paper sheet. It is also possible during the papermaking process that the sheet material being manufactured can expand in the cross-machine direction as it travels between processing equipment. It will be readily apparent that the apparatus and method of the present invention will provide an expansion profile as readily as a shrinkage profile.

With the apparatus and method of the present invention, a shrinkage or expansion profile can be obtained quickly and efficiently. It is simply a matter of installing the apparatus and carrying out the method of the present invention between positions that are upstream and downstream of a processing step that results in shrinkage or expansion of the sheet material. Easily obtainable shrinkage or expansion profiles allow for better shrinkage modelling within each grade of paper being produced due to more frequent use and better control of sheet variation in the cross-machine direction due to more accurate alignment of a scanned sheet property at a particular downstream location with the upstream actuator that must be adjusted to control the property at the location.

The foregoing discussion has dealt with apparatus and method for determining the shrinkage or expansion profile of a paper sheet during manufacture. It will be readily apparent that the apparatus and method of the present invention are not limited to use with papermaking equipment. Other equipment and processes for manufacturing sheet materials can benefit from incorporating the apparatus and method of the present invention suitably modified to take into account the sheet material being manufactured.

Although the present invention has been described in some detail by way of example for purposes of clarity and understanding, it will be apparent that certain changes and modifications may be practised within the scope of the appended claims.

We claim:

1. A method for determining the cross-machine shrinkage or expansion profile of a traveling sheet produced in a sheetmaking machine, the sheet moving from a first location to a second location comprising the steps of:

marking the sheet at the first location with an array of marks at measured, pre-determined intervals in the cross-machine direction using a mark applicator device;

inspecting the sheet in the cross-machine direction at the second location to measure the spacing of the array of marks using an optical inspection system capable of detecting the marks on the sheets; and developing a shrinkage or expansion profile of the traveling sheet based on the changes in the spacing between the array of marks at the second location.

2. A method as claimed in claim 1 in which the sheet is marked with a visible dye.

3. A method as claimed in claim 1 in which the sheet is marked with an invisible dye.

4. A method as claimed in claim 1 in which the sheet is marked with a fluid agent that is at a temperature different from the sheet material.

5. A method as claimed in claim 1 in which the mark applicator device comprises a dye applicator extending across the sheet in the cross-machine direction.

6. A method as claimed in claim 1 in which the marking step is performed at the first location in the sheetmaking machine where the sheet is first formed.

7. A method as claimed in claim 1 in which the inspecting step is performed at the second location in the sheetmaking machine after the formed sheet has been dried.

8. A method as claimed in claim 1 in which the spacing of the marks at the second location is determined by measuring the distance between the centers of the marks.

9. Apparatus for determining the cross-machine shrinkage or expansion profile of a traveling sheet produced in a sheetmaking machine, the sheet moving from a first location to a second location comprising:

means for marking the sheet at the first location with an array of marks at measured, pre-determined intervals in the cross-machine direction; and means for inspecting the sheet in the cross-machine direction at the second location to measure the spacing of the array of marks whereby the changes in the spacing between the array of marks at the second location as compared to the first location are used to develop a shrinkage or expansion profile of the traveling sheet.

10. Apparatus as claimed in claim 9 in which the means for inspecting the sheet comprises optical sensing means for detecting and measuring the position of the marks.

11. Apparatus as claimed in claim 10 in which the sheetmaking machinery is papermaking machinery having optical inspection equipment and the optical sensing means comprises the optical inspection equipment of the papermaking machinery adjusted to detect the marks on the sheet.

12. Apparatus as claimed in claim 9 in which the means for marking the sheet comprises a spray system extending across the sheet having a plurality of positionable spray nozzles for applying a marking agent to the sheet at a plurality of spaced locations.

13. Apparatus as claimed in claim 12 in which the marking agent is a liquid at a different temperature than the sheet material.

14. Apparatus as claimed in claim 12 in which the spray system comprises a dye distribution bar to release dye to the sheet.

15. Apparatus as claimed in claim 14 in which the dye is visible.

16. Apparatus as claimed in claim 14 in which the dye is invisible.

* * * * *